US006948437B2

(12) United States Patent
Hofmann et al.

(10) Patent No.: US 6,948,437 B2
(45) Date of Patent: Sep. 27, 2005

(54) THERMAL SHIELDING BRICK FOR LINING A COMBUSTION CHAMBER WALL, COMBUSTION CHAMBER AND A GAS TURBINE

(75) Inventors: Daniel Hofmann, Orlando, FL (US); Paul-Heinz Jeppel, Waltrop (DE); Hans Maghon, Mülheim A.D. Ruhr (DE); Uwe Rettig, München (DE); Milan Schmahl, Mülheim A.D. Ruhr (DE); Christine Taut, Dresden (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/380,854

(22) PCT Filed: Sep. 5, 2001

(86) PCT No.: PCT/DE01/03404

§ 371 (c)(1),
(2), (4) Date: Mar. 18, 2003

(87) PCT Pub. No.: WO02/25197

PCT Pub. Date: Mar. 28, 2002

(65) Prior Publication Data

US 2003/0172856 A1 Sep. 18, 2003

(30) Foreign Application Priority Data

Sep. 18, 2000 (DE) ..... 100 46 094

(51) Int. Cl.[7] ..... F23M 5/02

(52) U.S. Cl. ..... 110/338

(58) Field of Search ..... 60/754, 755, 756, 60/757, 758, 759, 760, 752, 753; 110/336, 338, 340; 432/14, 30, 252

(56) References Cited

U.S. PATENT DOCUMENTS

| | | | | |
|---|---|---|---|---|
| 1,883,983 A | | 10/1932 | Lanyon | |
| 2,125,192 A | * | 7/1938 | Morlock | 52/89 |
| 2,462,289 A | * | 2/1949 | Rochow | 52/232 |
| 3,073,067 A | * | 1/1963 | Shonkwiler | 52/232 |
| 3,828,735 A | * | 8/1974 | Graham et al. | 122/6 A |
| 4,246,852 A | * | 1/1981 | Werych | 110/336 |
| 4,835,831 A | * | 6/1989 | Melton | 29/460 |
| 4,840,131 A | * | 6/1989 | Meumann et al. | 110/336 |
| 5,083,424 A | | 1/1992 | Becker | |
| 5,404,721 A | * | 4/1995 | Hartsock | 60/300 |
| 5,431,020 A | | 7/1995 | Maghon | |
| 5,592,814 A | * | 1/1997 | Palusis et al. | 60/770 |
| 6,612,248 B2 | * | 9/2003 | Becker | 110/336 |

FOREIGN PATENT DOCUMENTS

| | | | |
|---|---|---|---|
| DE | 698685 | | 1/1941 |
| DE | 1558568 | | 4/1970 |
| DE | 0724487 | * | 4/1991 |
| DE | 0724116 | * | 1/1995 |
| DE | WO 99/47874 | * | 9/1999 |
| EP | 0260867 | | 3/1988 |
| EP | 0672880 | | 9/1995 |
| WO | 9947874 | | 9/1999 |

* cited by examiner

*Primary Examiner*—Kenneth Rinehart
(74) *Attorney, Agent, or Firm*—Harness, Dickey & Pierce, P.L.C.

(57) ABSTRACT

A thermal shielding brick is useable for lining a combustion chamber wall. The thermal shielding brick has a hot side, which can be exposed to a hot medium a wall side located opposite the hot side, and a peripheral side that is joined to the hot side and to the wall side. A damping element is placed on the peripheral side and effectively prevents fragments from detaching from the thermal shielding brick if broken. A combustion chamber having an inner combustion chamber lining, includes the thermal shielding bricks. Further, a gas turbine, includes the combustion chamber.

18 Claims, 1 Drawing Sheet

THERMAL SHIELDING BRICK FOR LINING A COMBUSTION CHAMBER WALL, COMBUSTION CHAMBER AND A GAS TURBINE

This application is the national phase under 35 U.S.C. §371 of PCT International Application No. PCT/DE01/03404, which has an International filing date of Sep. 5, 2001, which designated the United States of America and which claims priority on German Patent Application number DE 100 46 094.1 filed Sep. 18, 2000, the entire contents of which are hereby incorporated herein by reference.

FIELD OF THE INVENTION

The invention generally relates to a thermal shielding brick. In particular, it relates to a brick for lining a combustion chamber wall, having a hot side which can be exposed to a hot medium, a wall side opposite the hot side, and a peripheral side adjoining the hot side and the wall side. The invention also generally relates to a combustion chamber having a combustion chamber wall and to a gas turbine having a combustion chamber.

BACKGROUND OF THE INVENTION

Combustion spaces, such as, for example, a furnace, a hot-gas duct or a combustion chamber of a gas turbine, are known in which a hot medium is produced and/or directed. A thermally and/or thermomechanically highly loaded combustion space is provided with an appropriate lining in order to protect it from excessive thermal stressing. The lining of the combustion space is normally made of heat-resistant material and protects a wall of the combustion space from direct contact with the hot medium, for example a hot combustion gas, and from the associated high thermal loading. In addition, the combustion gases may have oxidative and/or corrosive constituents, which may have a lasting adverse effect on the combustion chamber wall if acted upon directly. There is therefore considerable interest in developing and improving the lining of a combustion space.

U.S. Pat. No. 4,840,131 discloses a fastening of ceramic lining elements to a wall of a furnace. In this case, a rail system which is fastened to the wall and has a plurality of ceramic rail elements is provided. The lining elements can be retained on the wall by the rail system. Further ceramic layers may be provided between a lining element and the wall of the furnace, inter alia a layer of loose, partly compressed ceramic fibers, this layer having at least the same thickness as the ceramic lining elements or a greater thickness. The lining elements in this case have a rectangular geometry with a planar surface. The lining elements are made of a heat-insulating refractory ceramic fiber material.

The application of a refractory lining to a wall of a furnace is likewise treated in U.S. Pat. No. 4,835,831. The refractory lining in this case is arranged in particular on a vertical wall. A layer consisting of glass fibers, ceramic fibers or mineral fibers is applied to the metallic wall of the furnace. This layer is fastened to the wall by metallic clamps or by adhesive. A wire mesh net having honeycomb meshes is applied to this layer. The mesh net likewise serves to protect the layer of ceramic fibers from falling down. By means of a suitable spraying process, a uniform closed surface of refractory material is applied to the layer fastened in this way. The method described largely avoids a situation in which refractory particles striking during the spraying are thrown back, as would be the case with direct spraying of the refractory particles onto the metallic wall.

Another type of lining of a thermally highly loaded combustion space is specified in EP 0 419 487 B1. The lining consists of thermal shielding elements which are mechanically retained on a metallic wall of the combustion space. The thermal shielding elements touch the metallic wall directly. In order to avoid excessive heating of the wall, e.g. as a result of direct heat transfer from the thermal shielding element or by ingress of hot medium into the gaps formed by the thermal shielding elements which adjoin one another, cooling air, the "sealing air", is admitted to the space formed by the wall of the combustion space and the thermal shielding element. The sealing air prevents the penetration of hot medium up to the wall and at the same time cools the wall and the thermal shielding element.

EP 0 724 116 A2 discloses a ceramic lining for walls of thermally highly stressed combustion spaces, for example of gas-turbine combustion chambers. The lining consists of wall elements made of high-temperature-resistant structural ceramic, e.g. silicon carbide (SiC) or silicon nitride ($Si_3N_4$). The wall elements are elastically fastened to a metallic supporting structure (wall) of the combustion chamber in a mechanical manner by means of a central fastening bolt. A thick thermal insulating layer is provided between the wall element and the wall of the combustion space, so that the wall element is at an appropriate distance from the wall of the combustion chamber. The insulating layer, which in relation to the wall element is about three times as thick, is made of refractory ceramic material which is prefabricated in bricks. The dimensions and the external shape of the wall elements can be adapted to the geometry of the space to be lined.

A wall segment for a combustion space and a combustion space of a gas turbine are described in WO 99/47874. Specified in this case is a wall segment for a combustion space, to which a hot fluid can be admitted, having a metallic supporting structure and a thermal protection element fastened to the metallic supporting structure. Inserted between the metallic supporting structure and the thermal shielding element is a deformable separating layer, which is intended to absorb and compensate for possible relative movements of the thermal shielding element and the supporting structure. Such relative movements may be caused, for example, in the combustion chamber of a gas turbine, in particular an annular combustion chamber, by different thermal expansion behavior of the materials used or by pulsations in the combustion chamber, which may arise during irregular combustion for producing the hot working medium or due to resonance effects. At the same time, the separating layer causes the relatively inelastic thermal protection element to rest in a more planar manner overall on the separating layer and the metallic supporting structure, since the thermal protection element penetrates at least partly into the separating elements. The separating layer is thus also able to compensate for production-related unevenness on the supporting structure and/or the thermal protection element, which unevenness may lead locally to an unfavorable concentrated introduction of force.

SUMMARY OF THE INVENTION

An embodiment of the invention is based on the observation that, in particular ceramic, thermal shielding elements, on account of their requisite flexibility with regard to thermal expansions, are often only inadequately protected against mechanical loads, such as, for example, shocks or vibrations. An object of an embodiment of the invention is accordingly to specify an improved thermal shielding brick which ensures greater operating reliability, in particular relative to the abovementioned requirements. A further object of an embodiment of the invention is to specify a combustion chamber having an inner combustion chamber lining and to specify a gas turbine having a combustion chamber.

The object which relates to a thermal shielding brick is achieved according to an embodiment of the invention by a thermal shielding brick, in particular for lining a combustion chamber wall, having a hot side which can be exposed to a hot medium, a wall side opposite the hot side, and a peripheral side adjoining the hot side and the wall side, a damping element being attached to the peripheral side.

An embodiment of the invention shows a completely new way of providing lasting protection for thermal shielding bricks against high accelerations resulting from shocks or vibrations. In this case, the invention is already based on the knowledge that steady and/or transient vibrations in a combustion chamber wall induce corresponding vibrations in combustion chamber bricks as are normally used for lining the combustion chamber wall. In this case, in particular in the event of resonance, high accelerations about a limit acceleration may occur, in the course of which the thermal shielding bricks lift from the combustion chamber wall and consequently strike again. Such striking on the solid combustion chamber wall leads to very high forces on the thermal shielding bricks and may cause considerable damage to the latter. This leads to a considerable reduction in the endurance of the thermal shielding bricks. In the worst case, the thermal shielding brick may fracture during such striking, there being the immediate risk of the fragments being released from one another and passing into the combustion space. Smaller or even larger fragments in the combustion space may consequently cause considerable damage to components in the combustion space. As a result, in particular when a thermal shielding brick is used in a gas turbine, the turbine connected downstream of a combustion chamber, for example an annular combustion chamber of a gas turbine, may be considerably damaged.

The risk of fragments being released from a thermal shielding brick, in particular made of a ceramic material, is considerably reduced by an embodiment of the invention. In this case, the proposed damping element which is attached to the peripheral side of the thermal shielding brick performs two functions. Firstly, the damping element damps possible shock loads, as may occur as the result of the use of the thermal shielding brick in a combustion chamber. Here, the attachment of the damping element to the peripheral side effectively damps in particular shocks or another local introduction of force on the peripheral side. If a combustion space is lined with a multiplicity of thermal shielding bricks arranged next to one another in such a way as to cover the surface, relative movements between the thermal shielding bricks may lead to such shocks on the peripheral side. Therefore the risk of fracture is already reduced in a preventative manner and the operating reliability is thereby increased by the damping element.

In addition to this object, however, the damping element according to the concept of an embodiment of the invention fulfills the additional task of preventing fragment-induced damage during use of the thermal shielding brick in a combustion chamber. For, if an incipient crack or a material crack should occur in the combustion chamber brick as a result of a considerable shock load, the damping element at the same time fulfills the task of a protective element for the combustion chamber brick. In this function, the damping element protects a possibly flawed or already broken thermal shielding brick against release of one or more fragments from the combustion chamber brick. With an embodiment of the invention, therefore, the passive safety of the thermal shielding brick in a possible shock fracture case is taken into account for the first time.

Prolonged use of the thermal shielding brick can be ensured by the proposed damping and protective element. With the damping element, the thermal shielding brick has emergency running properties in the event of special incidents, so that consequential damage, for example for the blading of a turbine, can be avoided. This is especially advantageous when the thermal shielding brick is used in a combustion chamber, since the thermal shielding function continues to be ensured, in particular no fragments can pass into the combustion space, even after a fracture. In economic terms, this additionally results in the advantage that, in the normal case, no exceptional maintenance and/or inspection of a combustion chamber having the thermal shielding brick is required. The combustion chamber with such a thermal shielding brick can be operated at least with the normal maintenance cycles, although the service life can be additionally increased on account of the increased passive safety.

In a preferred configuration, the damping element is attached in a planar manner. As a result, the peripheral side is connected to the damping element in a planar manner. This planar combination between the damping and protective element ensures considerable protection against release of possible fragments of the thermal shielding brick after a shock fracture or a material incipient crack caused in another manner or a crack through the material. By the planar attachment of the damping element, the thermal shielding brick is protected at the peripheral side in such a way as to cover at least a region of the surface. Cracks through the material which extending from the hot side up to the wall side and split the thermal shielding brick into at least two fragments, and in the most unfavorable case propagate up to the peripheral side, are bridged by the damping element at the peripheral side. By this crack bridging, release of the fragments from one another is virtually impossible, or is at least made much more difficult. The damping and protective element ensures that possible fragments are essentially held together, so that the thermal shielding brick can continue to perform its function.

In this case, by the arrangement and configuration of the damping element on the peripheral side, those regions where an incipient crack or a crack through the material is to be expected can be specifically protected. By the planar attachment, correspondingly large regions of the peripheral side are protected, as a result of which possible incipient cracks in the material or cracks through the material are bridged and as a result the continued operation, for instance when the thermal shielding brick is used in a gas-turbine combustion chamber, is not at critical risk.

The damping element is preferably designed as a woven fabric, in particular as a woven fabric mat. Used in this case are woven fabrics, or also woven fabric mats, which have sufficiently high damping properties (damping constant) and heat resistance to the high temperatures as are to be expected, for example, during use in a combustion chamber. In addition, the use of a woven fabric mat has the advantage that it can be trimmed to a desired size and can readily be attached to the thermal shielding brick at the peripheral side. Since the woven fabric mat is in close contact with the thermal shielding brick,.for example due to planar attachment, the material of the woven fabric mat should be selected in such a way that undesirable chemical reactions between the materials of mat and thermal shielding brick are ruled out. The damping and protective element may also be designed in the form of a knitted fabric, a braid or a sponge. Where it is appropriate, regions of the damping element may also be composed of these structurally different forms.

By the configuration of the damping and protective element as a woven fabric, in particular as a woven fabric mat, planar attachment to the peripheral side is facilitated and good adaptation to the geometry of the thermal shielding brick is possible. A special advantage results from the woven fabric structure, since in this way an excellent protective and supporting function of the crack bridging is achieved.

The damping element is advantageously made of a ceramic material, in particular of a ceramic fiber material. Ceramic material is resistant to high temperatures and is oxidation- and corrosion-resistant and is therefore eminently suitable for use in a combustion chamber. In addition, woven fabric mats of a ceramic material, in particular a ceramic fiber material, are commercially obtainable.

In this case, a ceramic mat, in particular a ceramic fiber mat, consists, for example, of ceramic fibers which are suitable for use at up to 1200° C. The chemical composition of these fibers is, for example, 62% by weight of $Al_2O_3$, 24% by weight of $SiO_2$ and 14% by weight of $B_2O_3$. The fibers in this case are composed of a multiplicity of filaments, the filaments having a diameter of about 10 to 12 $\mu$m. The maximum crystallite size is typically about 500 nm. Woven fabrics, knitted fabrics, or braids of the desired size and thickness can be produced from the ceramic fiber material in a simple manner. A plurality of layers of ceramic damping mats can also be produced as a damping and protective element for the thermal shielding brick. In this case, a plurality of layers may be sewn or knitted together to form a damping element. The high tear resistance and the thermal resistance of such ceramic woven fabric mats ensure high operating reliability and emergency running properties of the thermal shielding brick.

Furthermore, the damping element is preferably attached by adhesive bonding, in particular by use of a silicate-based adhesive. However, the damping element may also be attached to the peripheral side by clipping or screwing. The damping element may also be at least partly inserted into the parent material of the thermal shielding brick, e.g. cast or pressed in place. In the case of the adhesive bonding of the damping inlay with the parent material, both a conventional adhesive and a high-temperature-resistant adhesive may be used. Also, as mentioned above, silicate-based adhesives may be used, which have excellent adhesive properties and a high thermal resistance, a factor which is advantageous in particular during use in a gas-turbine combustion chamber.

The use of a ceramic or also a metallic mat, in particular a ceramic woven fabric mat, proves to be a further advantage for the connection, since said mat, on account of its woven fabric structure, has certain air permeability (porosity), a factor which promotes a sound connection of the damping and protective element to the parent material of the thermal shielding brick. In this case, the parent material of the thermal shielding brick is, for example, a ceramic material, in particular a refractory ceramic.

In a further preferred configuration, the peripheral side has an end face and a fastening side inclined relative to the end face, the damping element being provided on the end face. On account of the different geometrical forms and applications which may exist when using a thermal shielding brick in a combustion space, for example in a gas-turbine combustion chamber, it is advantageous to provide various regions of the peripheral side, namely an end face and a fastening side. By the inclination of the end face relative to the fastening side by an angle of inclination which depends on the geometry of the thermal shielding brick, the end face and the fastening side are generally different regions of the peripheral side. Therefore the damping element is preferably provided on the end face. However, depending on requirement and on the loading case, the damping element may also be attached at least partly to the fastening side. This is possible in such cases where unhindered fastening of the thermal shielding brick also does not prevent the damping element from being attached to the fastening side. It is advantageously possible, depending on the loading case and the installation geometry, to attach the damping element to the end face and also alternatively to the fastening side.

In this case, for example, a thermal shielding brick may have a parallelepiped-shaped geometry, in particular also with a square base area, it being possible for the peripheral side of the parallelepiped to be subdivided into four sectional sides on account of the geometry. Two opposite sectional sides then form the end faces of the parallelepiped, and the adjoining sides, inclined by 90 degrees, of the parallelepiped form, for instance, the fastening sides. It is consequently also possible to provide a plurality of end faces or a plurality of fastening sides in one thermal shielding brick. In general, prismatic thermal shielding bricks having a polygonal base area are possible. In addition, curved surfaces, for instance at the hot side or the wall side, are also conceivable. At the same time, a plurality of damping elements are preferably also attached to the peripheral side of the thermal shielding brick.

The fastening side preferably has a groove, in particular for accommodating a fastening element. When the thermal shielding brick is used in a combustion chamber, for example a gas-turbine combustion chamber, it is necessary to fasten the thermal shielding brick to the combustion chamber wall in a suitable manner. A groove in the thermal shielding brick, which may also be referred to as thermal-shielding-brick groove, fulfills this task. The thermal shielding brick can be fastened to a wall in the combustion space by means of a fastening element, for example a clip, a hook or a bolt. In the process, the fastening element engages in the groove. The thermal shielding brick in this case is advantageously fastened in a releasable manner, elastic retention of the thermal shielding brick also being possible. This has an advantageous effect on the damping properties of the thermal shielding brick and averts the risk of a shock fracture.

The object which relates to a combustion chamber my be achieved according to an embodiment of the invention by a combustion chamber having an internal combustion chamber lining which has thermal shielding bricks according to the above explanations.

The object which relates to a gas turbine may be achieved according to an embodiment of the invention by a gas turbine having such a combustion chamber.

The advantages of such a gas turbine and of such a combustion chamber follow in accordance with the above explanations in respect of the thermal shielding brick.

BRIEF DESCRIPTION OF THE DRAWINGS

The invention is explained in more detail by way of example with reference to the drawings, in which, schematically and partly simplified.

DETAILED DESCRIPTION OF THE PREFERRED EMBODIMENTS

Figure 1:
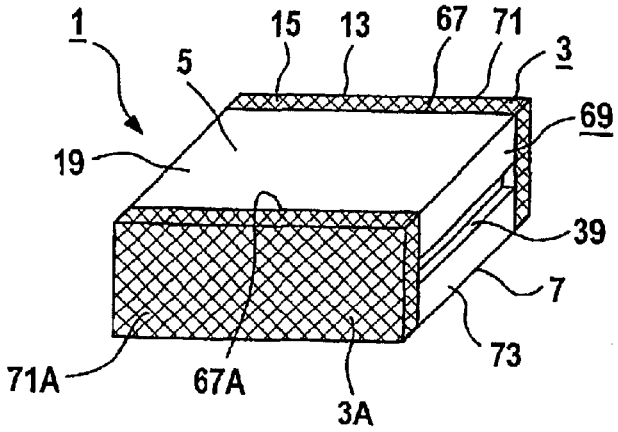
FIG. 1 shows a thermal shielding brick with damping element in a perspective view.

A thermal shielding brick 1 is shown in a perspective view in FIG. 1. The thermal shielding brick 1 is of parallelepiped-shaped design, in particular with a square base area. The thermal shielding brick 1 has a hot side 5 and a wall side 7 opposite the hot side 5. When the thermal shielding brick I is being used, for example in a combustion chamber of a gas turbine, the hot side 5 is acted upon by a hot medium, e.g. a hot combustion gas. A peripheral side 69 adjoins the hot side 5 and the wall side 7. In this case, the peripheral side is formed by the four side surfaces of the parallelepiped-shaped thermal shielding brick 1. The peripheral side 69 has an end face 71, 71A and a fastening side 73 inclined relative to the end face 71, 71A.

Figure 2:
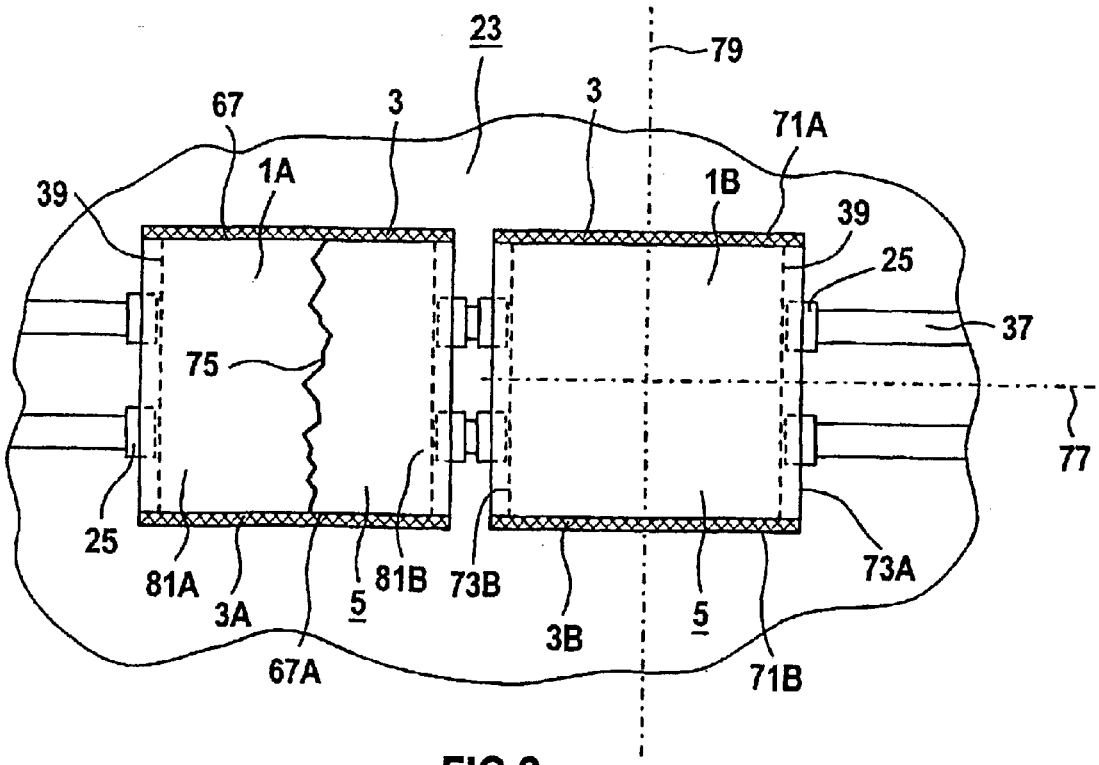
FIG. 2 shows a supporting structure with thermal shielding bricks fastened thereto.

The fastening side 73 has a groove 39, in particular a thermal-shielding-brick groove, for accommodating a fastening element not shown in any more detail (cf. FIG. 2 and the explanations in this respect). The groove 39 extends essentially parallel to the planes defined by the hot side 5 and the wall side 7. A damping element 3 and a further damping element 3A are attached to the peripheral side 69. The damping elements 3, 3A consist of a woven fabric mat 13 which has a ceramic material 15, in particular a ceramic fiber material. The damping elements 3, 3A are each attached to the peripheral side 69 with an adhesive 67. A firm connection between the woven fabric mat 13 and the parent material 19, for example a refractory ceramic, of the thermal shielding brick 1 is thus achieved.

Besides adhesive bonding, fastening of the damping elements 3, 3A to the peripheral side 69 in another way is also suitable. For example, the damping elements 3, 3A may be attached by screwing, clipping or the like, both fixed and releasable connections being advantageously possible. The damping elements 3, 3A are arranged in such a way that the damping element 3 is attached to the end face 71 and the damping element 3A is attached to the end face 71A opposite the end face 71. In this case, the end faces 71, 71A are provided with the respective damping element 3, 3A over the surface area, in particular over the full surface area. The thermal shielding brick, in particular at the end faces, is therefore protected in a very effective manner against shocks and shock-induced and/or thermally induced crack formation or cracks through the material. In addition to the damping of vibrations and/or shocks on the end faces 71, 71A, an increase in the passive safety and in emergency running properties is achieved. Crack formation which extends roughly from the hot side 5 up to the wall side 7 through the thermal shielding brick 1 and is possibly propagated up to the end faces 71, 71A is reliably bridged by the damping elements 3, 3A.

FIG. 2 shows a supporting structure 23, a thermal shielding brick IA and a further thermal shielding brick 1B being fastened to the supporting structure 23. For fastening, the supporting structure 23 has fastening grooves 37 which extend parallel to a longitudinal axis 77. In this case, the fastening groove 37 is configured, for example, as a milled-out portion in the supporting structure 23. The thermal shielding bricks 1A, 1B are fastened to the supporting structure 23 adjacent to one another along the longitudinal axis 77 via a respective fastening element 25.

For fastening, the fastening element 25 engages in the groove 39, in particular the thermal-shielding-brick groove, of the thermal shielding brick 1A, 1B. The thermal shielding bricks 1A, 1B are arranged in such a way that the fastening side 69 having the groove 39 runs parallel to a transverse axis 79, the transverse axis 79 being essentially perpendicular to the longitudinal axis 77. The end face 67, 67A having the damping element 3, 3A, 3B extends essentially parallel to the longitudinal axis 77. The thermal shielding brick 1A has a fracture 75 which extends along the transverse axis 79 from the end face 67 to the end face 67A opposite the end face 67. The fracture 75 is bridged by the damping and protective element 3 at the end face 67 and by the damping and protective element 3A at the end face 67A. Due to the firm connection between the damping elements 3, 3A and the thermal shielding brick 1A in order to bridge the crack, the fragments 81A, 81B cannot be released from the supporting structure 23. The thermal shielding brick 1A therefore essentially maintains its function and its thermal shielding properties. The risk of one of the fragments 81A, 81B possibly being released is therefore effectively countered.

The supporting structure 23 shown in FIG. 2 having the thermal shielding bricks 1A, 1B may be used, for example, as a lining of a combustion chamber wall, for example a combustion chamber wall of a gas-turbine combustion chamber. In this case, the combustion chamber wall is normally lined with thermal shielding bricks 1A, 1B in such a way as to cover the surface. With a combustion chamber which has thermal shielding bricks 1, 1A, 1B of the above explanations, damped, in particular flexible, retention of the thermal shielding bricks 1A, 1B in the supporting structure 23 can be achieved. The result of this is that the combustion chamber lining has very little susceptibility to shocks or vibrations. In this case, the thermal shielding bricks 1A, 1B having a damping and protective element 3, 3A, 3B are resistant both for the admission of a hot medium at the high temperatures, for example up to 1400° C. in a gas turbine, and to a high mechanical energy input as a result of shocks and/or vibrations.

The passive safety of a combustion chamber or of a gas turbine which has such a combustion chamber is markedly increased by the damping element 3, 3A, 3B. The thermal shielding brick 1A, 1B has emergency running properties in the event of special incidents, so that consequential damage, for example for the turbine part of the gas turbine, can be safely avoided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thermal shielding brick, comprising:

a hot side, exposable to a hot medium;

a wall side opposite to the hot side;

a peripheral side adjoining the hot side and the wall side, the peripheral side including an end face and a fastening side including a groove and being inclined relative to the end face; and a damping element firmly attached only to the end face of the peripheral side by a connection;

wherein the damping element has a shock load damping quality.

2. The thermal shielding brick as claimed in claim 1, wherein the firm connection is releasable.

3. The thermal shielding brick as claimed in claim 1, wherein the damping element is designed as a woven fabric.

4. The thermal shielding brick as claimed in claim 1, wherein the damping element is attached by adhesive bonding.

5. The thermal shielding brick of claim 1, wherein the thermal shielding block is for lining a combustion chamber wall.

6. The thermal shielding brick as claimed in claim 1, wherein the damping element is designed as a woven fabric mat.

7. The thermal shielding brick as claimed in claim 1, wherein the damping element is made of a ceramic fiber material.

8. The thermal shielding brick as claimed in claim 1, wherein the damping element is attached by a silicate-based adhesive.

9. The thermal shielding brick as claimed in claim 1, wherein the damping element is made of a ceramic material.

10. The thermal shielding brick as claimed in claim 1, wherein the groove is for accommodating a fastening element.

11. The thermal shielding brick as claimed in claim 1, wherein the damping element is planar.

12. The thermal shielding brick as claimed in claim 11, wherein the damping element is designed as a woven fabric.

13. The thermal shielding brick as claimed in claim 11, wherein the damping element is designed as a woven fabric mat.

14. A combustion chamber comprising an internal combustion chamber lining including at least one thermal shielding brick as claimed in claim 1.

15. A gas turbine comprising a combustion chamber as claimed in claim 14.

16. A thermal shielding brick, comprising:

a hot side, exposable to a hot medium;

a wall side opposite the hot side;

a peripheral side adjoining the hot side and the wall side, the peripheral side including an end face and a fastening side including a groove and being inclined relative to the end face; and a damping element firmly attached only to the end face of the peripheral side by a connection;

wherein the damping element includes a ceramic material.

17. A thermal shielding brick, comprising:

a hot side, exposable to a hot medium;

a wall side opposite the hot side;

a peripheral side adjoining the hot side and the wall side, the peripheral side including an end face and a fastening side including a groove and being inclined relative to the end face; and means for damping a shock load, which is attached only to the end face of the peripheral side.

18. A thermal shielding brick, comprising:

a hot side, exposable to a hot medium;

a wall side opposite the hot side;

a peripheral side adjoining the hot side and the wall side, the peripheral side including an end face and a fastening side including a groove and being inclined relative to the end face; and a damping element firmly attached only to the end face of the peripheral side, the damping element being such that resists oxidation;

wherein the damping element has a shock load damping quality.

* * * * *